US010446297B2

(12) United States Patent
Miyagawa et al.

(10) Patent No.: US 10,446,297 B2
(45) Date of Patent: Oct. 15, 2019

(54) RESISTOR

(71) Applicant: KOA CORPORATION, Nagano (JP)

(72) Inventors: Masaki Miyagawa, Nagano (JP); Kyohei Miyashita, Nagano (JP); Hiroshi Sakai, Nagano (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 16/083,088

(22) PCT Filed: Feb. 20, 2017

(86) PCT No.: PCT/JP2017/006236
§ 371 (c)(1),
(2) Date: Sep. 7, 2018

(87) PCT Pub. No.: WO2017/154547
PCT Pub. Date: Sep. 14, 2017

(65) Prior Publication Data

US 2019/0096549 A1 Mar. 28, 2019

(30) Foreign Application Priority Data

Mar. 8, 2016 (JP) ..... 2016-045044

(51) Int. Cl.
*H01C 1/14* (2006.01)
*H01C 1/148* (2006.01)
(Continued)

(52) U.S. Cl.
CPC ..... *H01C 1/14* (2013.01); *H01C 1/148* (2013.01); *H01C 7/00* (2013.01); *H01R 4/183* (2013.01); *H01R 11/12* (2013.01)

(58) Field of Classification Search
CPC . H01C 1/14; H01C 1/148; H01C 7/00; H01R 4/183; H01R 11/12
See application file for complete search history.

(56) References Cited

U.S. PATENT DOCUMENTS 5,252,944 A * 10/1993 Caddock, Jr. ..... H01C 1/084 257/675
5,304,977 A 4/1994 Caddock, Jr.
(Continued)

FOREIGN PATENT DOCUMENTS

FR 1086993 A 2/1955
JP S60-73228 U 5/1985
(Continued)

OTHER PUBLICATIONS

JP 03-29288, Izeki et al. Machine translation. (Year: 1991).*

*Primary Examiner* — Kyung S Lee
(74) *Attorney, Agent, or Firm* — Carrier Blackman & Associates, P.C.; William D. Blackman; Joseph D. Carrier

(57) ABSTRACT

A power resistor has paired harness electric wires that have one end parts connected to a resistor substrate, and other end parts pass through an exterior material made of insulating resin and extend outward. Crimp terminals, which are means for reinforcing affinity between the coating material of the harness electric wires and the insulating resin, i.e., the exterior material and for maintaining adhesion, are formed on predetermined portions of the harness electric wires. As a result, a short and small power resistor suitable for an in-vehicle environment is provided.

5 Claims, 6 Drawing Sheets

(51) Int. Cl.

| | |
|---|---|
| ***H01R 4/18*** | (2006.01) |
| ***H01C 7/00*** | (2006.01) |
| *H01R 11/12* | (2006.01) |

(56) References Cited

U.S. PATENT DOCUMENTS

| | | | | |
|---|---|---|---|---|
| 6,543,102 | B1 * | 4/2003 | Zitzmann | G01F 1/6845 29/612 |
| 7,843,309 | B2 * | 11/2010 | Zandman | H01C 1/014 338/195 |

FOREIGN PATENT DOCUMENTS

| | | | |
|---|---|---|---|
| JP | H03-29288 | A | 2/1991 |
| JP | H05-226106 | A | 9/1993 |

* cited by examiner

RESISTOR

TECHNICAL FIELD

The present invention relates to a power resistor for heat dissipation (resistor for high power resistor). In particular, it relates to a resistor for in-vehicle use.

BACKGROUND ART

According to conventional power supply circuits and high voltage/heavy current circuits such as power conversion circuits, a cement resistor, which is fabricated by putting a winding type resistor unit or a metal oxide film resistor unit into a ceramic case and then sealing it with silicon resin (cement), or an enamel resistor fabricated by winding a resistance wire around a porcelain bobbin and covering it with enamel, etc. are used. In particular, since the power converter for vehicles such as hybrid electric vehicles (HEV) needs a high power resistor for discharging the electric charge accumulated in the smoothing capacitor, a large-sized cement resistor is used.

Moreover, the power resistor designed to be mountable on a printed circuit board in a state being attached to a heat sink has been developed (e.g., Patent Document 1). According to the resistor given in Patent Document 1, parts of metal terminals (lead wires) 21 and 22 projecting from the bottom of a long and narrow synthetic resin main body 10 are embedded in a resin main body, a portion exposed outside of the resin main body extends linearly and has a shape in which width in the vicinity of the tip part is smaller than that on the main body side, so as to be mountable on a printed circuit board.

On the other hand, Patent Document 2 discloses a structure of a fixed resistor for heating and freeze proofing from which coated electric wires are taken out, wherein a circuit formed surface on a ceramic substrate is covered by an insulating material, and the covered wires are taken out from the insulating coating part.

PRIOR ART DOCUMENTS

Patent Documents

Patent Document 1: JP Hei5-226106A (Japanese Patent No. 2904654)

Patent Document 2: JP Hei3-29288A

DISCLOSURE OF THE INVENTION

Problem to be Solved by the Invention

Since the cement resistor described above has a large external form, and heat generated by the resistor may adversely affect the surrounding electronic circuit, it is difficult to mount it when physically separated from the other parts, and the mounting place is also restricted when using it as a high power discharging resistor in the in-vehicle environment with limited space, which is a problem.

Moreover, the resistor disclosed in Patent Document 1 has the following problems: it is limited to install on a printed circuit board, and leading the wiring around to other places than the printed circuit board is impossible, because metal terminals (lead wires) have a form and structure that do not bend easily even if an external force is applied. This causes the following problems: when connecting one end of a lead wire prepared separately to a terminal by soldering etc. without inserting the terminal in a hole (via hole) of the printed circuit board, electric and mechanical reliability and safety at connection portions cannot be secured, resulting in high possibility of failures such as disconnection or a short circuit in in-vehicle environments with much mechanical vibration.

On the other hand, the fixed resistor of Patent Document 2, which is not assumed to be mounted on a printed circuit board, has a structure in which only coated electric wire parts are extended out from the insulation coating parts in order to attach the resistor to a pipe etc. that requires heat proofing and freeze proofing. Instead, in order to raise the mechanical strength of the resistor, a structure that improves the bonding strength between the electrodes and the coated electric wires is adopted, wherein a reinforcement frame made of ceramics etc. is mounted on a circuit formation surface and sealed with an insulating material, and furthermore, the coated electric wires are secured by a depression made in a side wall of the reinforcement frame and also by the ceramic substrate. Therefore, the resistor is not only enlarged, but also increase in costs accompanying complication in structure occurs.

The present invention is made in light of the problems described above, and the object of the invention is to provide a low profile and small power resistor suitable for use in in-vehicle environments.

Means of Solving the Problem

The following structures are one means to solve the above problem and reach the object. That is, a resistor according to the present invention is characterized by including a resistor substrate that comprises on an insulating substrate, paired electrodes and a resistive element, which is connected to the respective paired electrodes, an insulating exterior material covering at least the upper and the side surface of the resistor substrate, and a pair of coated electric wires that have one end parts connected to the respective paired electrodes, pass through the insulating exterior material and extend outside;

wherein the resistor has a means, on respective predetermined portions of the pair of coated electric wires, for maintaining adhesion between coatings of the pair of coated electric wires and the insulating exterior material.

The means maintaining adhesion are characterized in that they are pipe members, each of which has a circumferential projection, and allows the pair of coated electric wires to pass through at the respective predetermined portions and to be fixed on the predetermined portions by applying a pressure from the circumference, for example. Furthermore, the means for maintaining adhesion are characterized in that they are made up of concave parts formed in the surfaces of the respective coatings of the predetermined portions of the pair of coated electric wires, for example. Yet further, the predetermined portions are characterized in that they are either borders between portions of the pair of coated electric wires covered by the exterior material and portions exposed to the outside of the exterior material or portions covered by the exterior material, for example. Yet even further, the pair of coated electric wires are harness electric wires, each of which extends outside of the exterior material in the same direction, and connection terminals are crimped to the respective other end parts.

Results of the Invention

A resistor according to the present invention having a structure in which a pair of coated electric wires pass through an exterior material and extend outward may be provided; wherein adhesion of the exterior material to a coating material of the coated electric wires is maintained while reduction in profile and size are attained.

BRIEF DESCRIPTION OF DRAWINGS

FIGS. 1A and 1B show external oblique views of a power resistor according to an embodiment, wherein FIG. 1A is an external oblique view of the power resistor when viewed from the front, and FIG. 1B is an external oblique view of the resistor when viewed from the back;

FIGS. 6A and 6B show enlarged views of parts in which are formed concave parts according to the structure example 2 of attaching harness electric wires, wherein FIG. 6A is an example in which a concave part is formed in an electric wire by applying a power evenly from all directions, and FIG. 6B is an example in which a concave parts are formed in predetermined portions of an electric wire by applying an external force in a horizontal direction or in a vertical direction;

DESCRIPTION OF EMBODIMENTS

Figure 1A:
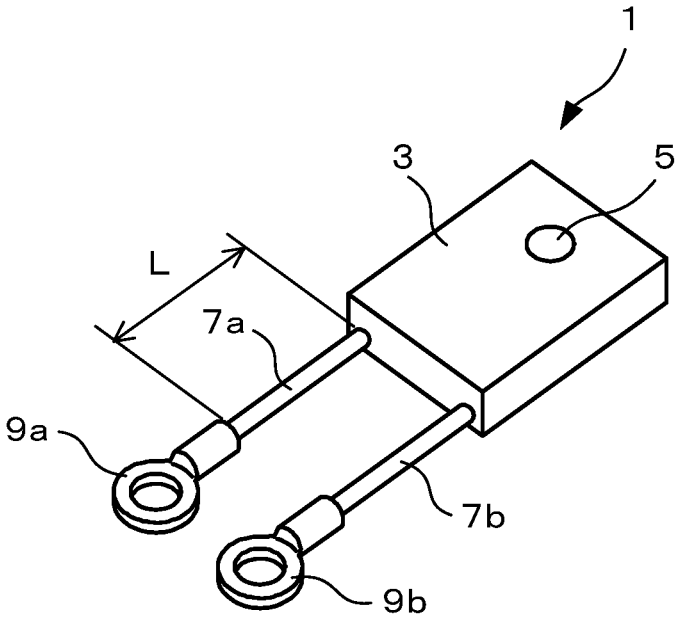
Figure 1B:
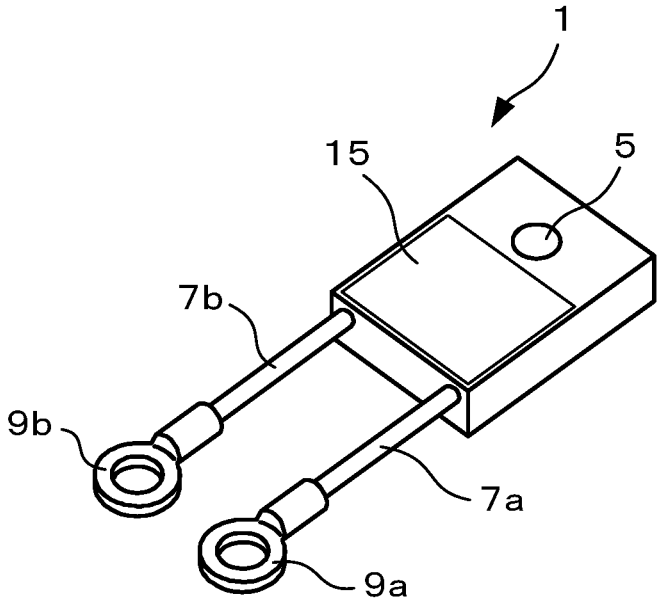
Figure 2:
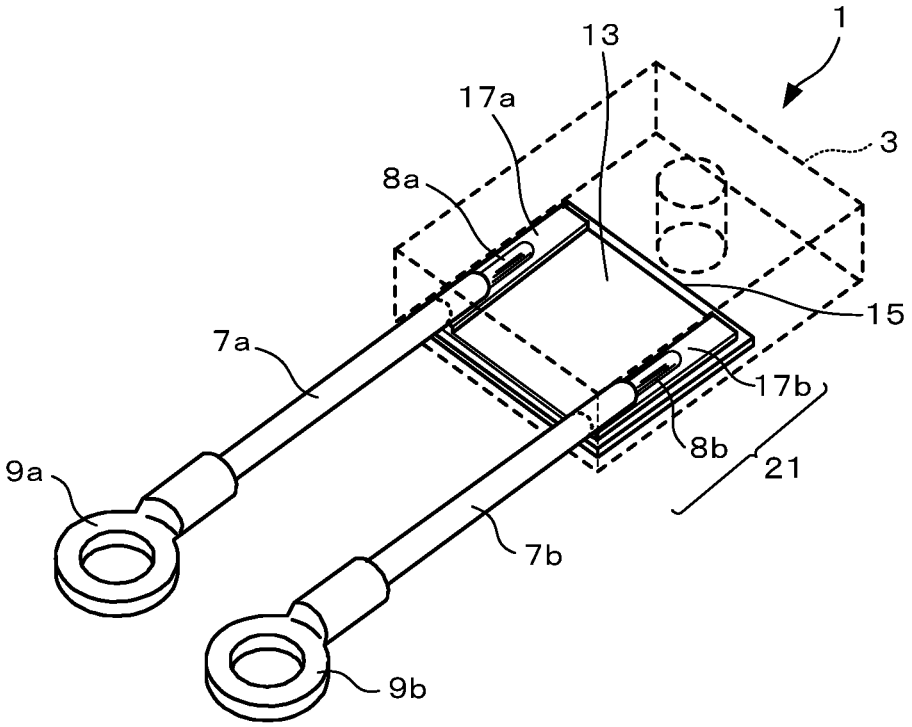
FIG. 2 is a perspective view showing an internal structure of the power resistor according to the embodiment.

An embodiment of the present invention is described below in detail with reference to accompanying drawings. FIGS. 1A and 1B show external oblique views of a power resistor according to an embodiment, wherein FIG. 1A is an external oblique view of the power resistor when viewed from the front, and FIG. 1B is an external oblique view of the power resistor when viewed from the back. Moreover, FIG. 2 is a perspective view showing an internal structure of the power resistor according to the embodiment.

A power resistor 1 according to the embodiment has a resistor substrate 21 including paired electrodes 17*a* and 17*b* formed on a surface of an insulating substrate 15, which is made of alumina etc. and has a rectangular parallelepiped shape, and a resistive element 13 formed between the electrodes; wherein one end sides 8*a* and 8*b* of the paired harness electric wires 7*a* and 7*b* are connected to the respective electrodes 17*a* and 17*b* by soldering etc., and the other end sides are exposed to the outside of a power resistor main body 3 (also referred to as exterior body, mold resin body, or exterior resin body). The insulating substrate 15 is made thinner in thickness of alumina etc. so as to lower the thermal resistance, thereby allowing the high power resistor to maintain heat dissipation performance.

The resistor substrate 21 is covered by insulating resin (mold resin) such as epoxy resin except for the undersurface. Therefore, the back of the insulating substrate 15 is exposed to the outside of the resistor main body 3, as shown in FIG. 1B, and by attaching the power resistor 1 to a case of an external device, etc., as will be described later, heat generated by the resistive element 13 on the resistor substrate 21 is conducted to a case in which it is installed, thereby radiating the heat. Note that the outer shape of the resistor main body 3 has the same size as the generic package (TO-247), for example.

The electrodes 17*a* and 17*b* are made of a metal material, such as a silver based material or a silver-palladium based material, and in the case of silver-palladium based material, a palladium-rich alloy is desirable. Moreover, the resistive element 13 is a thick film resistor made of a ruthenium oxide based material, for example, and is formed through screen-printing etc.

The harness electric wires 7*a* and 7*b* maintain insulation by covering core wires, which are metal conductors, with insulating resin, and are made up of respective portions of the harness electric wires 7*a* and 7*b* housed in the resistor main body 3 (portions covered by exterior resin) and respective portions exposed to the outside of the resistor main body 3. Therefore, even if a harness electric wire is in contact with some other metal part after the power resistor is installed, no short circuits etc. occur. Furthermore, round terminals (ring terminals) 9*a* and 9*b* are crimped by using caulking etc. to respective tip parts of the harness wires 7*a* and 7*b* exposed to the outside of the resistor main body 3 so as to connect and fix the harness wires 7*a* and 7*b* to other electric apparatus, parts, etc. with screws etc. Several options of length L of the exposed portions of the harness electric wires 7*a* and 7*b* are prepared according to usage, such as a mounting place of the power resistor 1, for example.

In the resistor main body 3, an attaching hole 5, which passes through between the surface and the back of the resistor main body 3, is formed near the opposite end part to the location of the resistor substrate 21. This attaching hole 5 is a through-hole for a screw with which the power resistor 1 is attached to a heat sink, a case of another instrument, etc., as will be described later.

A harness electric wire attaching structure of the power resistor according to the embodiment is described below in detail. In the case where Teflon resin (Teflon is a registered trademark), for example, is used as a coating material, which constitutes coating sections of the harness electric wires 7*a* and 7*b* of the power resistor 1, a problem occurs that Teflon® resin, which is a coating material of the harness electric wires, is incompatible with epoxy resin, which is an insulating resin of the main body 3, at the portions of the harness electric wires 7*a* and 7*b* covered by the insulating resin (mold resin) of the resistor main body 3. In other words, adhesion or adhesiveness between these kinds of resin is not favorable, and thus resistance of the harness electric wires against the pulling force from the outside is weaker. This causes a problem that, for example, the harness electric wires may break away from (e.g., fall off) the resistor main body.

The power resistor according to the embodiment has a harness electric wire attaching structure, i.e., a means to maintain adhesion between the coating material of the harness electric wires and the insulating resin of the resistor main body, which will be described below.

Attaching Structure Example 1

Figure 3:
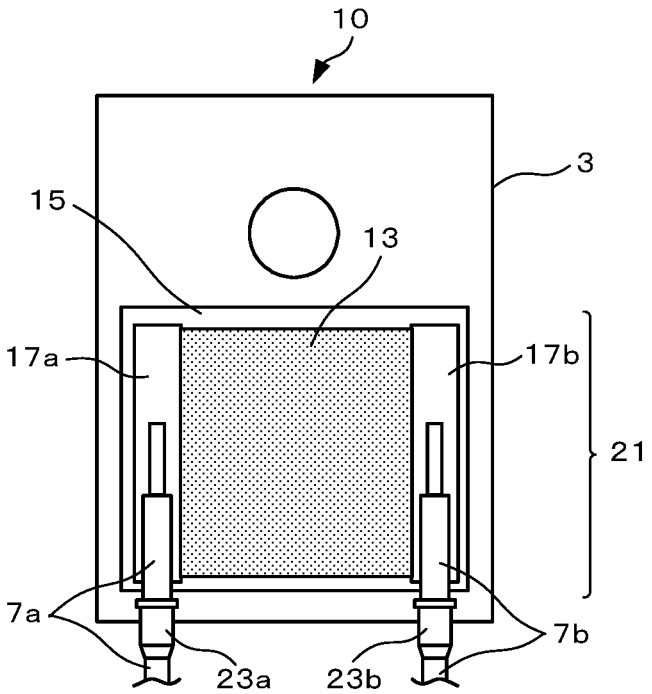
FIG. 3 is an illustration for explaining a structure example 1 of attaching harness electric wires in the power resistor according to the embodiment.

FIG. 3 is an illustration for explaining a structure example 1 of attaching harness electric wires in the power resistor according to the embodiment. According to the attaching structure example 1, crimp terminals 23*a* and 23*b* are attached to predetermined portions of the harness electric wires 7*a* and 7*b* connected to the electrodes 17*a* and 17*b* of the power resistor 10, for example, boundary between the portion where harness electric wires 7*a* and 7*b* are covered by the insulating resin in the resistor main body 3, and the portion where harness electric wires 7*a* and 7*b* are exposed to the outside of the insulating resin.

In more detail, positions at which the crimp terminals 23*a* and 23*b* are attached to the harness electric wires 7*a* and 7*b* are where the insulating resin covering the entire resistor substrate 21 to which the harness electric wires 7*a* and 7*b* are connected covers the upper halves of the crimp terminals 23*a* and 23*b* in the length direction, and the lower halves in the length direction are exposed to the outside of the insulating resin.

Figure 4:
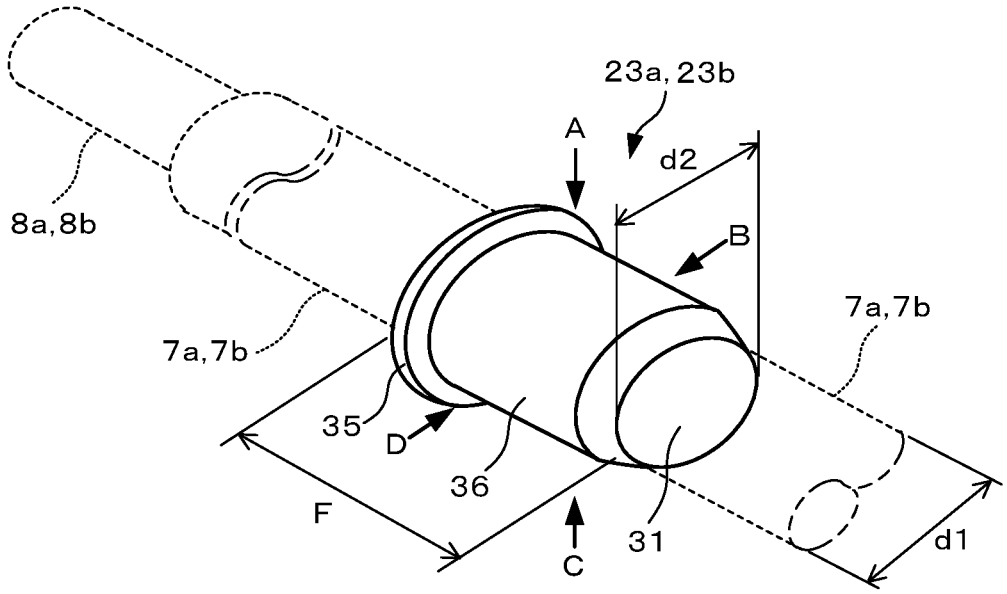
FIG. 4 is an external oblique view of a crimp terminal in the attaching structure example 1 of the power resistor according to the embodiment.

FIG. 4 is an external oblique view of the crimp terminals 23*a* and 23*b*. The crimp terminals 23*a* and 23*b* are terminals made of either resin compatible with mold resin, such as epoxy resin, or terminals made of a metal such as aluminum, and have tubular components 3 to 4 mm in full length F, each of which includes a pipe 36 with a through-hole 31 having nearly the same diameter d2 as diameter d1 of the harness electric wires 7*a* and 7*b*, and a projection 35 formed around one end part of the pipe 36.

When attaching the crimp terminals 23*a* and 23*b* to the respective harness wires 7*a* and 7*b*, as shown in FIG. 4, the harness electric wires 7*a* and 7*b* from which the coatings at the end parts (the end parts 8*a* and 8*b*) are removed are each made to pass through a through-hole 31, and with the tip parts of the harness electric wires 7*a* and 7*b* protruding only a predetermined length further from the projection 35, external forces are applied on the pipe 36 in the four directions A to D (or either in the two directions A and C or in the two directions B and D) as shown in FIG. 4, thereby crushing the crimp terminals 23*a* and 23*b* in the axial direction and crimping them to the harness electric wires 7*a* and 7*b*.

As such, adhesion between the coating material of the harness electric wires and the insulating resin of the power resistor main body is secured by attaching the crimp terminals 23*a* and 23*b* to respective borders between portions of the harness electric wires 7*a* and 7*b* covered by the insulating resin of the power resistor main body and corresponding portions exposed to the outside of the insulating resin. Moreover, since the crimp terminals 23*a* and 23*b* along with the projection 35 formed in the end part absorb stress from a pulling force from the exterior, the harness electric wires do not fall out from the main body of the power resistor even if the pulling force acts on the harness electric wires. Furthermore, since adhesion is secured, weather resistance such as moisture resistance may be improved.

Attaching Structure Example 2

Figure 5:
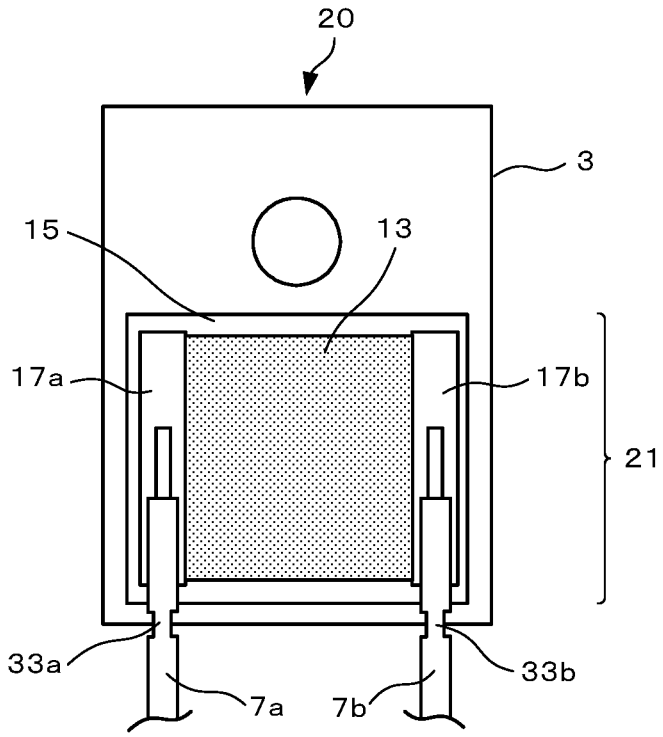
FIG. 5 is an illustration for explaining a structure example 2 of attaching harness electric wires in the power resistor according to the embodiment.

FIG. 5 is an illustration for explaining a structure example 2 of attaching harness electric wires in the power resistor according to the embodiment. According to the attaching structure example 2, concave parts 33*a* and 33*b* are formed on the respective surfaces of portions of the harness electric wires 7*a* and 7*b* pulled out from the insulating resin of the main body 3 of the power resistor 20 (borders between portions covered by the insulating resin and corresponding portions exposed to the outside of the insulating resin).

The concave parts 33*a* and 33*b* are formed by applying to the coatings of the harness electric wires 7*a* and 7*b* a predetermined force (e.g., a force such as a crimping force externally applied) applied externally and thereby indenting the coatings. The external force applied at this time is to the degree that the indented portions of the harness electric wires 7*a* and 7*b* cannot return to the respective original forms due to elasticity of the coating material and does not damage the core wires of the harness electric wires.

Figure 6A:
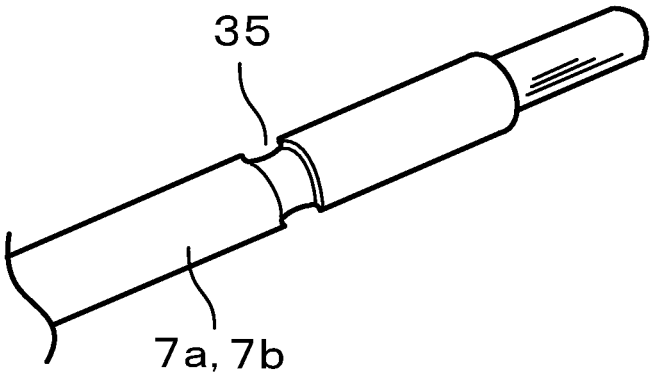
Figure 6B:
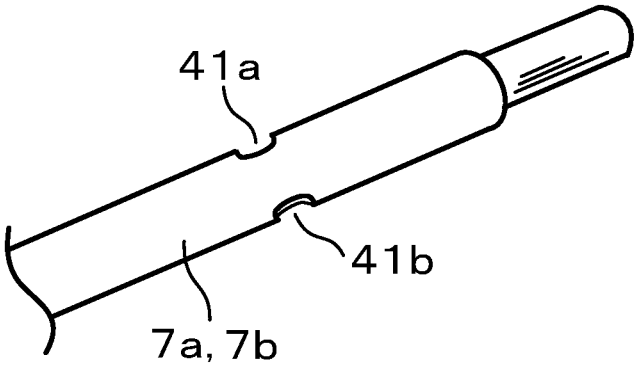

FIGS. 6A and 6B show enlarged views of parts in which the concave parts are formed in the above-described harness electric wires. FIG. 6A shows an example of forming a concave part 35 by evenly applying a force to predetermined parts of the harness electric wires 7*a* and 7*b* from all directions, resulting in the concave part 35 formed, indented around the respective coatings of the harness electric wires. Moreover, FIG. 6B is an example of forming concave parts 41*a* and 41*b* by applying an external force to predetermined parts of the harness electric wires 7*a* and 7*b* in two directions: i.e., from the right and the left (horizontally) or from above and below (vertically), and indenting mutually opposite portions of coatings of the harness electric wires.

As shown in the attaching structure example 2, since formation of concave parts at the portions of the coatings of the harness electric wires pulled out from the insulating resin of the power resistor main body allows the mold resin to enter the indents when covering the resistor substrate with insulating resin (mold resin) such as an epoxy resin, adhesion or adhesiveness between the coating material of the harness electric wires and the insulating resin of the power resistor main body is improved, and strength of the harness electric wires against an external pulling force is secured.

Attaching Structure Example 3

Figure 7:
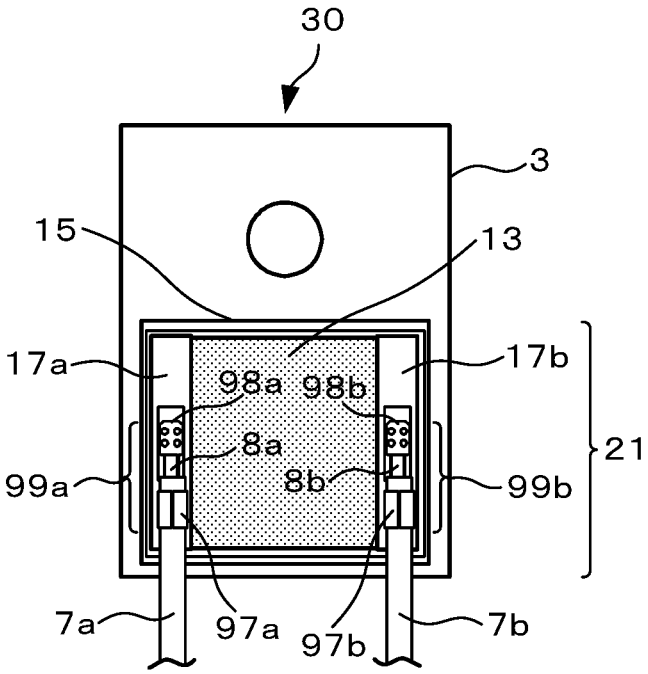
FIG. 7 is an illustration for explaining a structure example 3 of attaching harness electric wires in the power resistor according to the embodiment.

FIG. 7 is an illustration for explaining a structure example 3 of attaching harness electric wires of the power resistor according to the embodiment. Here, on the resistor substrate 21 of the power resistor 30, metal crimp terminals 99*a* and 99*b* are attached to the respective end parts of the harness electric wires 7*a* and 7*b*, coatings 97*a* and 97*b* are crimped at respective borders with the respective tip parts 8*a* and 8*b* of the harness electric wires using those crimp terminals, and the tip parts 8*a* and 8*b* are partially covered. These partially covered parts 98*a* and 98*b* are joined together with the respective electrodes 17*a* and 17*b* by soldering or welding. This secures reliability in a strong connection between the harness electric wires and the electrodes against stress even if an external pulling force is applied to the harness electric wires.

Other Attaching Structure Examples

According to the example shown in FIG. 6A, a single concave part is formed around a portion of the coating of a harness electric wire. On the other hand, according to the example shown in FIG. 6B, concave parts are formed by indenting two mutually opposite portions of the coating of a harness electric wire. The number of the concave parts formed is not limited to these numbers. For example, a same shaped concave part as the concave part 35 of FIG. 6A may be formed in several portions of the harness electric wire covered by the insulating resin. Moreover, same shaped concave parts as the concave parts 41*a* and 41*b* of FIG. 6B may be formed in additional portions of the harness electric wire covered by the insulating resin.

Furthermore, in the case where several concave parts are formed at the above-described portions of the harness electric wires, the concave part 35 shown in FIG. 6A and the concave parts 41*a* and 41*b* of FIG. 6B may be intermixed in the coating of the same harness electric wire. According to the attaching structure example 1 described above, although the crimp terminals 23*a* and 23*b* are attached at the respective borders between respective portions of the resistor main body 3 covered by the insulating resin and respective portions exposed to the outside of the insulating resin, the structure is not limited to this, and for example, the entire crimp terminals 23*a* and 23*b* may be covered by the insulating resin. Furthermore, according to the attaching structure example 2 described above, although the concave parts are formed at the respective portions of the harness electric wires pulled out from the insulating resin of the power resistor main body, positions of the concave parts are not limited thereto. For example, they may be positions where the entire concave parts formed in the coatings of the harness electric wires are covered by the insulating resin.

On the other hand, while illustration is omitted, since the harness electric wires have many curved portions in the insulating resin by meandering and arranging the portions of the harness electric wires covered by the insulating resin of the power resistor main body, strength against an external pulling force acting on the harness electric wires is given for preventing an electric wire from falling out etc.

Figure 8:
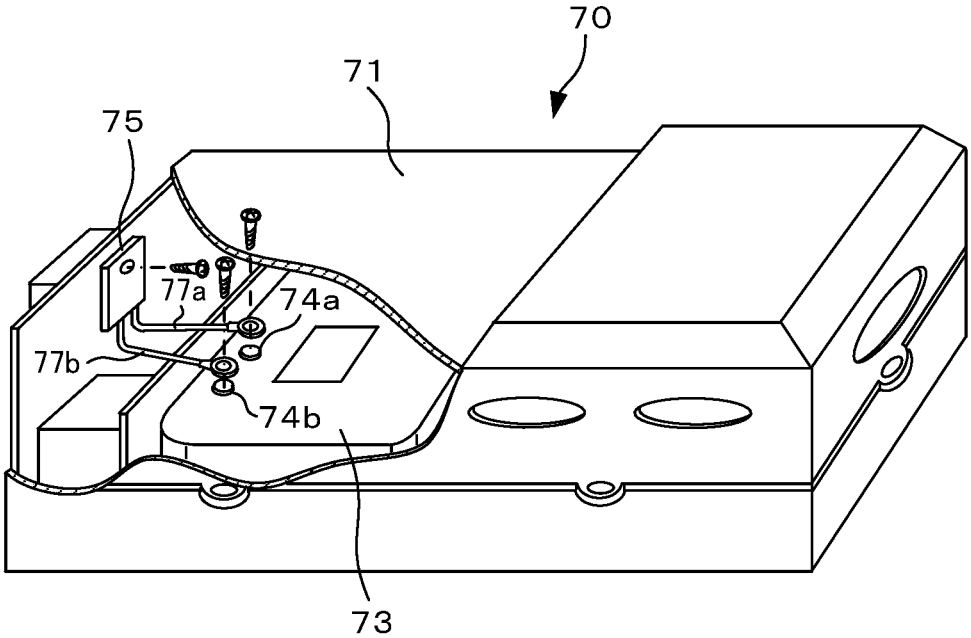
FIG. 8 is a schematic view of the power resistor according to the embodiment when mounted in a PCU of a HEV.

The power resistor according to the embodiment is a high power resistor with a rated power of approximately 100 W, for example, and may be used as a continuous discharging resistor that slowly consumes the electric charge accumulated in a capacitor, which is for voltage smoothing and stabilization, equipped in the power control unit (PCU) of a hybrid electric vehicle (HEV). FIG. 8 shows a schematic view of an example of mounting the power resistor according to the embodiment in a PCU of an HEV. In FIG. 8, a smoothing capacitor 73 is stored in a case 71 for a power control unit (PCU) 70, wherein a power resistor 75 is fixed to the case 71 with a screw. The power resistor 75 is fixed so that the back of the insulating substrate, which is a radiating surface, adheres to the case 71.

Here, by fixing ring terminals that are attached at the tip parts of the harness electric wires 77*a* and 77*b* of the power resistor 75 to respective connection terminals 74*a* and 74*b* of the smoothing capacitor 73 with a screw, the power resistor 75 and the smoothing capacitor 73 are connected electrically. Since the power resistor 75 functions as a discharging resistance, the charge accumulated in the smoothing capacitor 73 is constantly discharged, and heat generated by the power resistor 75 can be released to the case 71 in which it is installed.

Figure 9:
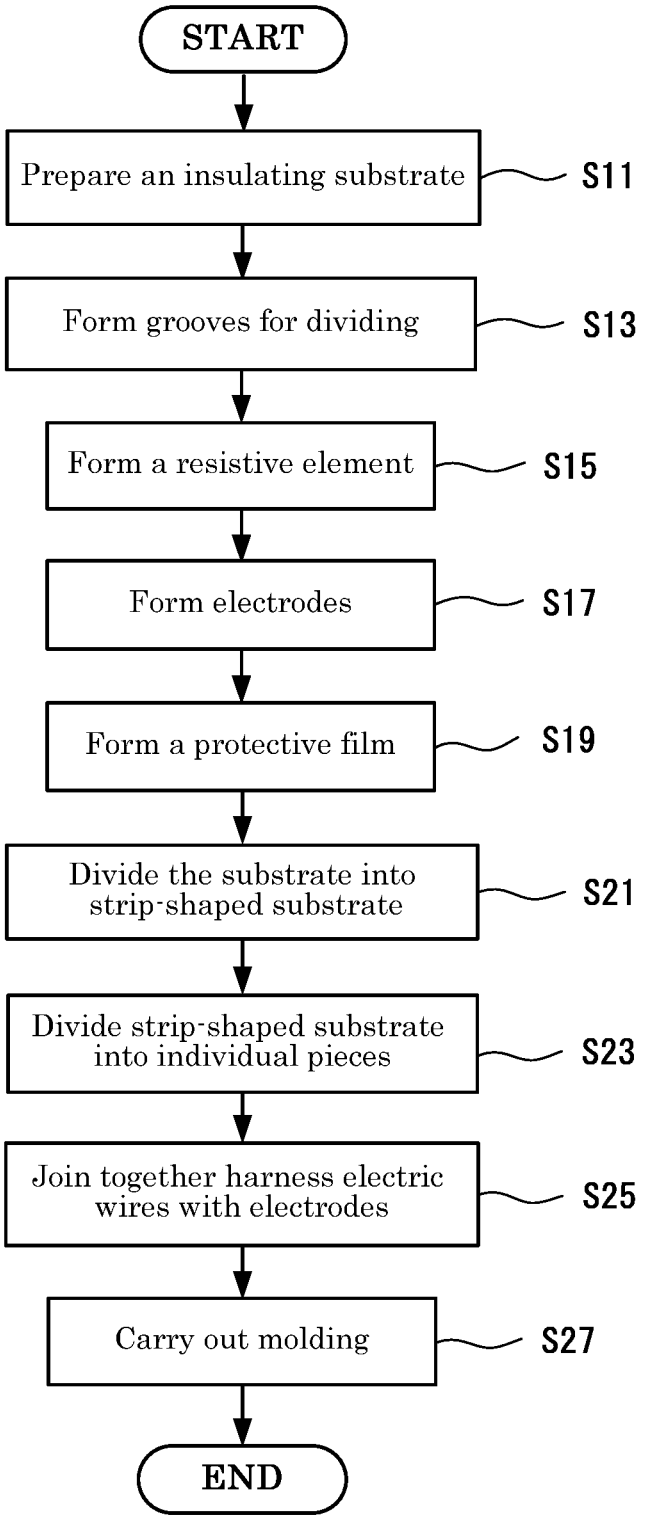
FIG. 9 is a flow chart showing a manufacturing process of the resistor of the embodiment in time series.

A manufacturing process of the resistor according to the embodiment is described below. FIG. 9 is a flow chart showing the manufacturing process of the resistor according to the embodiment in time series. In the first step S11, an insulating substrate for the resistor is prepared. Here, a large-sized insulating substrate, such as an alumina substrate having excellent electric insulation and thermal conductivity, which provides many chips, is prepared. In the subsequent step S13, grooves for dividing the substrate, that is, grooves for primary dividing and grooves for secondary dividing are formed on the front and the back surface of the insulating substrate.

In step S15, a resistive element is formed by screen printing and firing (sintering) a rectangular-shaped resistive paste, for example. In the subsequent step S17, paired electrodes are screen-printed and sintered, sandwiching the resistive element formed in step S15 described above. An electrode paste, such as a silver (Ag) based material or a silver-palladium (Ag—Pd) based material referred above, is used as the electrode material. In step S19, an insulating protective film is formed. While illustration is omitted here, the protective film is formed by printing glass on the paired electrodes, so as to cover the entire upper surface of the resistive element and exposing junctions with the harness electric wires, which will be described later.

In step S21, primary dividing is carried out along dividing lines made up of grooves running in one direction prepared on the substrate in advance, so that the substrate is divided into strip-shaped substrates. In the subsequent step S23, secondary dividing is carried out on the strip-shaped substrate along the grooves prepared beforehand in the perpendicular direction to the above described one direction so as to divide the resistor into individual pieces.

In step S25, harness electric wires are prepared in which ring terminals are attached to one end parts and coatings of the other end parts (portions indicated by symbols 8*a* and 8*b* in FIG. 2 etc.) are partially removed by only a predetermined length, to which the processing described in the attaching structure example 1 or 2 is subjected. Then the other end parts with coatings removed are joined together with the respective junctions of the electrodes by soldering or welding. In the final step S27, molding is carried out, the upper and the side surface of the resistor substrate are entirely covered by insulating resin, such as epoxy resin, except that only the undersurface side is exposed, and a through-hole for screwing down is formed.

Note that while electrodes are formed after a resistive element has been formed in the above-described example, the resistive element may alternatively be formed after forming the electrodes. Moreover, in a step after the resistive element has been formed, resistance adjustment (trimming) of the resistive element may be carried out by, for example, measuring the resistance between the electrodes and making a cut in the resistive element pattern by a laser beam, sandblasting, etc. according to the measured resistance.

The power resistor according to the embodiment described above has a structure in which one end parts of the paired harness electric wires are connected to the respective electrodes formed on the resistor substrate that is covered by the exterior material made of the insulating resin, and which the harness electric wires pass through the exterior material, extending outward; and the structure has a means for reinforcing affinity between the coating material of the harness electric wires at predetermined portions of the harness electric wires and the insulating resin, which forms the exterior material, and for maintaining adhesion. This certainly prevents the harness electric wires from loosening or breaking away from the external material even if an external force acts on the harness electric wires.

Moreover, the means for maintaining adhesion described above has either a structure of crimping and attaching the crimp terminals with almost the same diameter as that of the harness electric wires to the border where the harness electric wires are exposed to the outside of the insulating resin, or a structure of forming concave parts on the surface of the border of the harness electric wires. This allows improvement in adhesion between these resins within a partial range of the power resistor main body which does not require enlargement of the thickness and external form of the power resistor, thereby allowing reduction in profile and size of the high power resistor while maintaining heat dissipation performance. As a result, application to in-vehicle use in particular becomes easier.

Furthermore, the structure of securing electric connection with the exterior of the resistor established by the harness electric wires, which extend and protrude from the exterior material of the power resistor, can bend flexibly and are covered by the insulating resin, not only makes a constitution for insulating from the metal case in which the power resistor is installed unnecessary, but also makes it possible to lead the wiring around in accordance with the circuit configuration in which it is mounted while avoiding obstacles in the path from the resistor to where it is installed. In addition, degree of freedom of selection of mounting place for the resistor for heat dissipation may be secured.

DESCRIPTION OF REFERENCE NUMERALS

1, 10, 20, 30, and 75: Power resistors
3: Resistor main body
5: Attaching hole
7*a*, 7*b*, 77*a*, and 77*b*: Harness electric wires
8*a* and 8*b*: Tip parts of harness wires with coating removed
9*a* and 9*b*: Round terminals (ring terminals)
13: Resistive element
15: Insulating substrate
17*a* and 17*b*: Electrodes
21: Resistor substrate
23*a*, 23*b*, 99*a*, and 99*b*: Crimp terminals
31: Through-hole
33*a*, 33*b*, 41*a*, and 41*b*: Concave parts
35: Projection
36: Pipe

The invention claimed is:

1. A resistor comprising: a resistor substrate that comprises on an insulating substrate, paired electrodes and a resistive element, which is connected to the respective paired electrodes, an insulating exterior material covering at least the upper and the side surface of the resistor substrate, and a pair of coated electric wires that have one end parts connected to the respective paired electrodes, pass through the insulating exterior material and extend outside;

wherein the pair of coated electric wires are harness electric wires made of metal conductors which are covered by an insulating coating material, each of which extends outside of the exterior material in the same direction, and connection terminals are crimped to other end parts thereof, respectively; and wherein the resistor has a metal maintainer, on respective predetermined portions of the pair of coated electric wires, crimped to the pair of coated electric wires for maintaining adhesion between the insulating coating material and the insulating exterior material.

2. The resistor according to claim 1, wherein the metal maintainer for maintaining adhesion are pipe members, each of which has a circumferential projection, and allows the pair of coated electric wires to pass through at the respective predetermined portions and to be crimped on the predetermined portions by applying a pressure from the circumference.

3. The resistor according to claim 1, wherein the predetermined portions are either borders between portions of the pair of coated electric wires covered by the exterior material and portions exposed to the outside of the exterior material or portions covered by the exterior material, separated from the one end parts of the pair of coated electric wires.

4. A resistor comprising: a resistor substrate that comprises on an insulating substrate, paired electrodes and a resistive element, which is connected to the respective paired electrodes, an insulating exterior material covering at least the upper and the side surface of the resistor substrate, and a pair of coated electric wires that have one end parts connected to the respective paired electrodes, pass through the insulating exterior material and extend outside;

wherein the pair of coated electric wires are harness electric wires made of metal conductors which are covered by an insulating coating material, each of which extends outside of the exterior material in the same direction, and connection terminals are crimped to other end parts thereof, respectively; and wherein metal terminals are attached to the respective end parts of the pair of coated electric wires, comprising junctions joined together with the electrodes partially covering the metal conductors at portions where the coatings of the other end parts are removed by a predetermined length, and crimping portions where the insulating coating material is crimped at respective borders with the respective tip parts of the pair of coated electric wires, where the junctions have at least four contacts.

5. The resistor according to claim 4, wherein each of the contacts has a round shape in a plan view.

* * * * *